US005124226A

United States Patent [19]

Yabuuchi et al.

[11] Patent Number: 5,124,226

[45] Date of Patent: Jun. 23, 1992

[54] DISPERSION-POLYMERIZATION PROCESS FOR PRODUCING A TONER CONTAINING A PIGMENT DISPERSED THEREIN

[75] Inventors: Naoya Yabuuchi; Masayuki Maruta; Chikayuki Otsuka; Akihiro Kanakura; Akio Kashihara, all of Osaka, Japan

[73] Assignee: Nippon Paint Co., Ltd., Osaka, Japan

[21] Appl. No.: 596,911

[22] Filed: Oct. 16, 1990

[30] Foreign Application Priority Data

Oct. 16, 1989 [JP] Japan ..... 1-270019
Oct. 16, 1989 [JP] Japan ..... 1-270020

[51] Int. Cl.[5] ..... G03G 9/08
[52] U.S. Cl. ..... 430/137
[58] Field of Search ..... 430/110, 109, 137

[56] References Cited

U.S. PATENT DOCUMENTS 3,104,068 9/1963 Castelli et al. ..... 241/16
4,789,617 12/1988 Arahara et al. ..... 430/137
4,963,455 10/1990 Laing et al. ..... 430/110
4,971,882 11/1990 Jugle ..... 430/110
5,034,297 7/1991 Yoerger ..... 430/110

FOREIGN PATENT DOCUMENTS 246814 11/1987 European Pat. Off. .
297839 1/1989 European Pat. Off. .

*Primary Examiner*—John Goodrow
*Attorney, Agent, or Firm*—Wenderoth, Lind & Ponack

[57] ABSTRACT

The present invention provides a process for producing toner which has very narrow particle size distribution and contains a uniformity dispersed pigment therein. The process comprises dispersion-polymerizing (I) a pigment paste comprising (A) a pigment grinding agent having basic groups, acidic groups or the both, (B) a pigment and (C) vinyl monomers,
(II) a polymerization initiator and
(III) a dispersion polymerization stabilizer in a dispersion medium which dissolves said vinyl monomers (C) and dispersion polymerization stabilizer (III) and which does not dissolve polymerized resin particles.

6 Claims, 1 Drawing Sheet

DISPERSION-POLYMERIZATION PROCESS FOR PRODUCING A TONER CONTAINING A PIGMENT DISPERSED THEREIN

FIELD OF THE INVENTION

The present invention relates to a process for producing toner which is suitable for developing electrostatic charged images in electrophotography, electrostatic recording and the like.

BACKGROUND OF THE INVENTION

Toner which develops electrical or electrostatic images is employed in various image forming techniques or recording techniques.

The toner has been produced by a grinding method wherein a thermoplastic resin is fused and uniformly mixed with a colorant (e.g. dye or pigment) and ground, followed by classifying to a desired particle size. The grinding method can produce good toner in some extent, but has a limitation in selectivity of resin. In other words, the resin which is used for the toner is required to be brittle for grinding, but the brittle resin forms a large amount of resin particles which are too small. The brittle resin also forms such too small particles in a copy machine.

In order to overcome the problems of the grinding method, Japanese Kokai Publication (unexamined) 10231/1961 proposes a suspension polymerization method wherein polymerizable monomers, colorant, initiator and charge controller are mixed in water to form a suspension and then polymerized to obtain resin particles having a desired particle size. The toner obtained by this method, however, has very broad particle size distribution for which a classification step is essential, thus resulting in poor yield. This problem is worse for such small toner that its particle size has recently been required 3 to 7 micrometer.

Japanese Kokai Publications (unexamined)273552/1986 and 73276/1987 propose a nonaqueous dispersion polymerization wherein monomers are polymerized in the presence of a pigment in a solvent which dissolves the monomers and which does not dissolve the polymerized particles. However, in this method, it is very difficult to disperse a pigment in the obtained resin particles. There may occur a flocculation of the pigment in the polymerizing system or may be free pigment flocculations present outside the polymerized resin particles.

SUMMARY OF THE INVENTION

The present invention provides a process for producing toner which has very narrow particle size distribution and contains pigment uniformly dispersed therein. The process of the present invention comprises dispersion-polymerizing (I) a pigment paste comprising (A) a pigment grinding agent having basic groups, acidic groups or the both, (B) a pigment and (C) vinyl monomers, (II) a polymerization initiator and (III) a dispersion polymerization stabilizer in a dispersion medium which dissolves said vinyl monomers (C) and dispersion polymerization stabilizer and which does not dissolve polymerized resin particles.

DETAILED DESCRIPTION OF THE INVENTION

In the present invention, an improvement is present in that the pigment is preliminary ground by a pigment grinding agent to form a pigment paste which is then incorporated into the polymerizing system. The pigment grinding agent employed in the present invention contains basic groups, acidic groups or the both, which are interacted with the reverse groups in the pigment to absorb the pigment. Accordingly, it is general that the pigment grinding agent having basic groups is suitable for an acidic pigment and also the pigment having acidic groups is suitable for a basic pigment. The pigment grinding agent may have both the acidic and basic groups in some case. Examples of the acidic groups are a carboxyl group, a phosphoric acid group, a sulfonic acid group, a mixture thereof and the like. Examples of the basic groups are an amino group, a quaternary ammonium group, a mixture thereof and the like. An amount of the basic or acidic groups is preferably within the range of from $5\times10^{-5}$ to $2\times10^{-3}$ mol/g. Amounts of less than $5\times10^{-5}$ deteriorate pigment grinding abilities. Amounts of more than $2\times10^{-3}$ reduce the solubility with the vinyl monomers and the pigment is not uniformly dispersed in the obtained particles.

The pigment grinding agent, if necessary, may have radically reactive groups, such as an ethylenically unsaturated double bond, a thiol group and the like. The radically reactive groups enhance the dispersibility of pigment and preferably are present in an amount of $5\times10^{-6}$ to $5\times10^{-3}$ the agent. Amounts of less than $5\times10^{-6}$ do not sufficiently enhance the dispersibility of pigment and those of more than $5\times10^{-3}$ often form gelation and encounter the difficulty of controlling polymerization reactions.

It is important that the pigment grinding agent has good affinity for the vinyl monomers, because the pigment included in the grinding agent is uniformly dispersed in the obtained toner particles. The affinity for the vinyl monomer is determined in the present invention by water tolerance or hexane tolerance. The water (hexane) tolerance herein is determined by dissolving 0.5 g of a material to be measured in 10 ml of acetone in a 100 ml beaker to which water (hexane) is added dropwise until one can not read a type letter of 44 degree Ming-style through the beaker. The water (hexane) tolerance is expressed as a water (hexane) amount when one could not read the type letter. It is preferred that the pigment grinding agent (A) has a water tolerance of 5.0 or less and the polymerization stabilizer (III) has water tolerance 7.0 or more. It is also preferred that the pigment grinding agent (A) has a hexane tolerance of 20 or less and the polymerization stabilizar (III) has a hexane tolerance of 30 or more. If the pigment grinding agent has a water (hexane) tolerance outside the above range, the pigment is not uniformly dispersed in the toner particles. If the polymerization stabilizer has a water (hexane) tolerance outside the above range, the polymerization system is not sufficiently stabilized.

The pigment grinding agent (A) of the present invention preferably has a number average molecular weight of 1,000 to 40,000, more preferably 2,000 to 12,000. If it is less than 1,000, the pigment will agglomerate. If it is more than 40,000, the obtained pigment paste is very viscous and the pigment is insufficiently dispersed therein. It is also preferred that the agent (A) has a glass transition temperature of 20° to 100° C., preferably 40° to 80° C. It the glass transition temperature is less than 20° C, the blocking of toner particles may arise. If it is more than 100° C, the toner particles are fixed on paper insufficiently.

The pigment grinding agent (A) of the present invention can be prepared by polymerizing monomers having acidic groups or basic groups with other monomer. Examples of the monomer having acidic groups or basic groups are an amino group-containing monomer, such as dimethylaminoethyl methacrylate, diethylaminoethyl methacrylate, dimethylaminoethylmethacrylamide etc.; a carboxyl group-containing monomer, such as methacrylic acid, maleic anhydride etc.; a sulfonic acid group-containing monomer, such as sodium p-styrenesulfonate etc.; a phosphoric acid group-containing monomer, such as an ethylene oxide modified acrylate, an ethylene oxide-modified methacrylate etc.; and the like. Examples of the other monomers are styrene, n-butyl methacrylate, t butyl methacrylate, cyclohexyl methacrylate, methyl methacrylate and the like. The agent (A) may also be prepared by adding an amine (e.g. dimethylamine, diethylemine etc.) to a polymer having epoxy groups (e.g. epoxy resin). It may further be prepared by reacting a polymer having hydroxyl groups (e.g. polyether polyol, polyester resin) with an acid anhydride (e.g. maleic anhydride, succinic anhydride and trimellitic anhydride).

In the present invention, a radically reactive group may be introduced into the pigment grinding agent (A). The introduction of the radically reactive groups is known to the art. The grinding agent (A) is not limited to the above mentioned one, any modification (e.g. grafting etc.) may be conducted thereon (See Japanese Kokai Publication Nos. 01-80434).

The pigment (B) of the present invention can be anyone known to the art, including carbon black, iron black, nigrosine, benzidine yellow, quinacridone, Rodamine D, phtharocyanine blue and the like. The pigment may be preliminary treated with a coating agent or a grafting agent in order to enhance dispersibility into the pigment paste.

The vinyl monomers (C) of the present invention can be anyone that is used for the toner preparations, and includes styrenes, such as styrene, o-methylstyrene, m-methylstyrene, p-methylstyrene, p-methoxystyrene, p-ethylstyrene and the like; a (meth)acryl acid ester, such as methyl (meth)acrylate, ethyl (meth)acrylate, propyl (meth)acrylate, n-butyl (meth)acrylate, isobutyl (meth)acrylate, n-octyl (meth)acrylate, dodecyl (meth-)acrylate, 2-ethylhexyl (meth)acrylate, stearyl (meth)acrylate, phenyl (meth)acrylate, dimethylaminoethyl (meth)acrylate, diethylaminoethyl (meth)acrylate and the like; acrylonitrile; acrylamide; and the like.

The pigment past (I) of the present invention is generally prepared by grinding a mixture of the above components (A), (B) and (C) in the presence of glass beads, iron particles etc. and then filtering the glass beads or iron particles off. In the pigment paste, the pigment (B) is contained in an amount of 0.2 to 10 parts by weight, preferably 1.0 to 5.0 parts by weight, and the vinyl monomers (C) are contained in an amount of 5.0 to 75 parts by weight, preferably 10 to 40 parts by weight, based on one parts by weight of the pigment grinding agent (A). Amounts outside the above range may cause pigment agglomerations, sedimentations, or high viscosity.

In the present invention, a lubricant (D) may be added in the pigment paste in order to effectively prevent off-set phenomonon. The lubricant (D) may be formulated into the paste in an amount of 1.0 to 50 parts by weight, preferably 2.5 to 25 parts by weight, based on 100 parts by weight of the vinyl monomers (C). Examples of the lubricants are polypropylene wax, polyethylene wax, polydimethylsiloxane and a modified wax thereof.

The polymerization initiator (II) of the present invention can be anyone used in this field, and includes azobisisobutylonitrile, 2,2'-azobis(2,4-dimethylvaleronitrile), 1,1 azobis(cyclohexane-1-carbonitrile), benzoyl peroxide, methyl ethyl ketone peroxide, isopropylperoxycarbonate, cumenhydroperoxide, 2,4-dichlorobenzoyl peroxide, lauroyl peroxide and the like.

The dispersion polymerization stabilizer (III) of the present invention is soluble in the dispersion medium and is insoluble in the vinyl monomers (C). The stabilizer (III) also is soluble in the mixture of the dispersion medium and the vinyl monomers upon polymerizing. If the dispersion medium is a high polar solvent, such as alcohols (e.g. methanol and ethanol), ethyleneglycol monoether (e.g. ethyleneglycol monoethyl ether and ethyleneglycol monomethyl ether) and a mixture thereof with water, then preferred stabilizers are celluloses, polyvinylpyrrolidone, polyacrylic acid, styrene-maleic acid copolymer, polyvinylacetate, vinyl acetate-vinylpyrrolidone copolymer, partially saponified polyvinylacetate and the like. If the dispersion medium is a low polar solvent such as an aliphatic hydrocarbon (e.g. hexane, heptane, mineral spirit) and a paraffinic solvent (e.g. Isopar E, Isopar G, Shellzol), then preferred stabilizers are rubbers (e.g. acrylonitrile-butadiene rubber, styrene butadiene rubber, butadiene rubber), an aminoplast resin (e.g. outylated melamine), rubber craft, an alkyd resin, polybutadiene, an acrylic resin and the like. In order to enhance the stability of dispersion polymerization and to narrow the particle size distribution, the dispersion polymerization stabilizer (III) may contain a radical polymerizable group and a chain transfer agent, as disclosed in Japanese Kakai Publication (unexamined) 304002/1988.

The dispersion medium of the present invention is one which dissolves the vinyl monomers (C) and the polymerization stabilizer (III) and which does not dissolve in the polymerized resin particles. If it is limited by water tolerance, examples of the mediums are alcohols, such as methanol, ethanol, isopropanol, n-propanol, isobutanol and the like; ethyleneglycol monoalkylethers, such as ethyleneglycol monomethyl ether and ethyleneglycol monoethyl ether; a mixture thereof with water; and the like. If it is limited by hexane tolerance, examples of the mediums are hydrocarbons, such as hexane, heptane, octane, xylene, mineral spirit, Isopar E, Isopar G and Shellzol.

In the present invention, in order to control the melting viscosity of the obtained toner particles, a crosslinking agent may be added to the polymerization system. Examples of the crosslinking agents are divinylbenzene, divinylnaphthalene, divinyl ether, divinyl sulfon, diethyleneglycol dimethacrylate, triethyleneglycol dimethacrylate, ethyleneglycol dimethacrylate, polyethyleneglyol dimethacrylate, diethyleneglycol diacrylate, triethyleneglycol diacrylate, 1,3-butyleneglycol dimethacrylate, 1,6-hexaneglycol dimethacrylate, neopentylglycol dimethacrylate, dipropyleneglycol dimethacrylate, 2,2'-bis(4-methacryloxyphenyl)propane, 2,2-bis(4-acryloxydiethoxyphenyl)propane, trimethylolpropane trimethacrylate, trimethylolpropane triacrylate, tetramethylolmethane tetraacrylate, dibromoneopentylglycol dimethacrylate, diallyl phthalate and the like.

The toner of the present invention may be magnetic toner, for which magnetic powder may be formulated into the polymerization formulations. Magnetic powder is one which is magnetized in a magnetic field, including a magnetic metal, such as iron, cobalt, nickel etc.; magnetite; hematite; ferrite; and the like.

An amount of the polymerization initiator (II) is within the range of 0.5 to 10% by weight based on the weight of the vinyl monomers (C). An amount of the polymerization stabilizer (III) is within the range of 0.001 to 0.4 parts by weight, based on one part by weight of the pigment paste (I). Also, the dispersion medium may be present in an amount of 1.5 to 15 parts by weight based on one part by weight of the pigment paste (I).

The dispersion polymerization is carried out with stirring at a temperature of 50° to 100° C. for 5 to 25 hours.

According to the present invention, the pigment is uniformly dispersed in the toner particles without forming agglomerations inside and outside the particles. The toner particles have superior volume resistivity and coloring power.

After finishing the dispersion polymerization, the obtained particles are isolated and dried to form toner particles. The isolation can be carried out by ordinary methods, such as a centrifugal separation, a filtration separation and the like. The drying process can be carried by vacuum drying and the like.

The obtained toner particles have a weight average particle size of 1.5 to 15 micrometer, a variation coefficient of 5 to 30 % (an index of particle size distribution), a glass transition temperature of 45 to 75° C., a number average molecular weight of 4,003 to 60,000, a volume resistivity of $10^{14}$ to $10^{16}$ ohm-cm, an activating energy of melting viscosity of 3.5 to 8.0 Kcal/mol.

According to the present invention, there provide small size toner particles which have narrow article size distribution and contain pigment uniformly dispersed therein.

EXAMPLES

Figure 1:
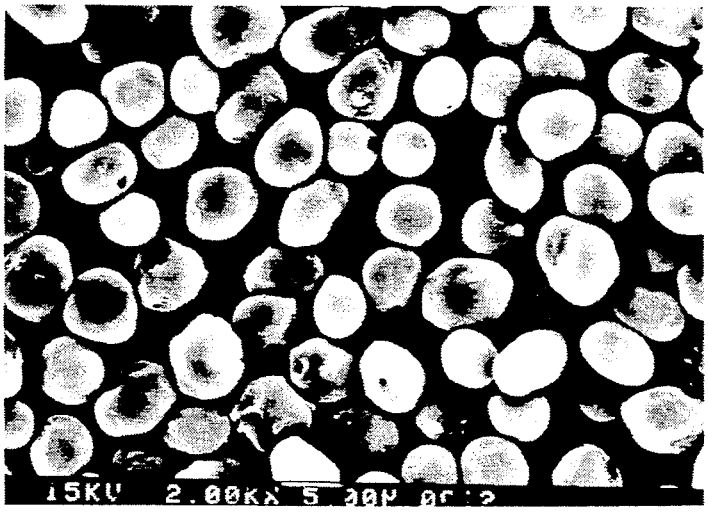
FIG. 1 is a photograph of the toner of Example 4 taken by an electron microscope.

The present invention is illustrated by the following examples which, however, are not to be construed as limiting the present invention to their details.

Synthesis of a Pigment Grinding Agent

Reference Example 1

(Carboxylic Acid/Sulfonic Acid Agent)

A two liter separable flask equipped with a temperature controller, a nitrogen gas introducing tube, a dropping funnel, an anchor type stirrer and a condenser was charged with 200 g of ethyleneglycol monoethyl ether acetate and 400 g of xylene and heated to 120° C. To the content, a mixture of 62 g of 2-hydroxyethyl methacrylate, 414 g of ethylhexyl methacrylate, 414 g of t-butyl methacrylate and 10 g of azobisisobutylonitrile was added dropwise over 3 hours and then reacted for another 2 hours. After cooling. 37 g of sulfophthalic anhydride was charged therein and heated to 130° C. At this temperature, a resin acid value was adjusted to 20 at which 182 g of epsilon-caprolactone and 1.2 g of dibutyltin laurate were added and heated to 140° C. The reaction continued until more than 93% by weight of epsilon-caprolactone had been reacted, and allowed to cool to obtain a pigment grinding agent.

Reference Example 2

(Basic Pigment Grinding Agent)

A same reaction vessel as Reference Example 1 was charged with 600 g of ethyleneglycol monoethyl ether acetate and heated to 110° C. To the content, 105 g of diethylaminoethyl methacrylate, 280 g of ethylhexyl methacrylate, 305 g of styrene and 56 g of V-601 (azo initiator available from Wako Junyaku Co., Ltd.) were added dropwise over 3 hours. After finishing the addition, the reaction continued at 110° C. for one hour and at 130° C. for another one hour to obtain a pigment grinding agent having Mw 4,630 and Mn 2,070.

Reference Example 3

(A Basic Pigment Grinding Agent having a Graft Chain)

(Synthesis of Polymer I)

A same reaction vessel as Reference Example 1 was charged with 169.5 g of methyl isobutyl ketone and 340.5 g of ethyleneglycol monoethyl ether acetate and heated to 130° C. To the content, a mixture of 750 g of glycidyl methacrylate and 150 g of t-butylperoxy-2-ethyl hexanate was added dropwise for 3 hours and stirred for 30 minutes. Then, a mixture of 15 g of t-butylperoxy-2-ethyl hexanate and 75 g of ethyleneglycol monoethyl ether acetate was added dropwise for 30 minutes and stirred for one hour to obtain a polymer I. The obtained polymer I had a heat residue (105° C. for 3 hours) of 50%, an epoxy equivalent of 284 and an Mw/Mn =1,800/1,000 and was a homopolymer of 7 glycidyl methacrylates.

(Synthesis of Polymer II)

A same reaction vessel as Reference Example 1 was charged with 159.1 g of methyl isobutyl ketone and 572.5 g of ethyleneglycol monoethyl ether acetate and heated to 120° C. with stirring. Next, (a) 550 g of n-butyl methacrylate, (b) a mixture of 55.0 g of thioglycolic acid and 55.0 g of ethyleneglycol monoethyl ether acetate, and (c) a mixture of 11.1 g of 4,4'-azobis(4-cyanovaleric acid), 3.0 g of triethylamine and 30.0 g of ethyleneglycol monoethyl ether acetate were separately added dropwise for 3 hours and stirred for another one hour to terminate the reaction. The obtained polymer II has an acid value of terminal carboxylic groups of 29.0.

(Synthesis of a Graft Type Basic Pigment Grinding Agent)

A same reaction vessel as Reference Example 1 was charged with 340.8 g of the polymer I and 517 0 g of the polymer II, and a reaction of epoxy and carboxyl group was conducted at 90° C. with stirring until an acid value reached to 0.

Next, the reaction mixture was cooled to less than 50° C., to which 47.0 g of diethylamine was added and heated to 100° C. to conduct a reaction between epoxy group and secondary amine for 3 hours. The resultant mixture has an epoxy equivalent of 1,610,000 which showed that more than 99.9% epoxy group was reacted. The resultant mixture was kept 70° C. under a reduced pressure to remove excess amine with methyl isobutyl ketone. The obtained pigment grinding agent had an amine equivalent of 0.50 meq/g and an iodine value of 4.3, which showed that the obtained material was a basic graft polymer.

Reference Example 4

(An Acidic Pigment Grinding Agent)

A same reaction vessel as Reference Example 1 was charged with 600 g of 1,4-dioxane and heated to 100° C. A mixture of 100 g of methacrylic acid, 320 g of styrene, 120 g of n-butyl methacrylate, 160 g of n-hexyl methacrylate and 46 g of azobisisobutylonitrile was added dropwise for 2 hours. After the completion of the addition, the reaction continued for one hour to which 10.5 g of azobisisobutylonitrile and 100 g of xylene we:e added dropwise for one hour and polymerized for another 2 hours to obtain a pigment grinding agent having an Mw of 3,550 and an Mn of 1,520.

Reference Example 5

(An Acidic Pigment Grinding Agent)

(Synthesis of Polymer I)

A same reaction vessel as Reference Example 1 was charged with 476.0 g of ethyleneglycol monoethyl ether acetate and heated to 130° C. with stirring. To the content, a mixture of 315.3 g of glycidyl methacrylate, 384.7 g of 2-hydroxyethyl methacrylate and 70 g of t-butylperoxy-2-ethyl hexanate was added dropwise for 3 hours and stirred for 30 minutes. Then, a mixture of 7 g of t-butylperoxy-2-ethyl hexanate and 70 g of ethyleneglycol monoethyl ether acetate was added dropwise for 30 minutes and stirred for one hour to obtain a polymer I. The obtained polymer I had a heat residue (105° C. for 3 hours) of 55% and an epoxy equivalent of 596 and an Mw/Mn=3,400/1,800.

Synthesis of a Graft Type Acidic Pigment Grinding Agent)

A same reaction vessel as Reference Example 1 was charged with 472.5 g of the polymer I obtained above, 4,790.4 g of the polymer II of Reference Example 3 and 8.8 g of triethylamine, and a reaction of epoxy and carboxyl group was conducted with stirring until an epoxy equivalent reached to 250,000.

Next, 152.2 g of trimellitic anhydride was added thereto and heated to 120° C. to conduct a reaction between hydroxyl group and acid anhydride for 2 hours. The obtained pigment grinding agent had an acid value of 48 mg KOH/g, which showed that the obtained material was an acidic graft polymer.

Water (hexane) tolerances of the pigment grinding agents of Reference Examples 1 to 5 and the dispersion polymerization stabilizers of Examples 1 to 9 are shown in Table 1.

TABLE 1

| Pigment grinding agent | Dispersion polymerization stabilizer | Water tolerane | Hexane tolerane |
|---|---|---|---|
| Reference Example | | | |
| 1 | — | 2.6 | 7.2 |
| 2 | — | 3.3 | 8.3 |
| 3 | — | 2.4 | 10.6 |
| 4 | — | 1.7 | 15.4 |
| 5 | — | 2.3 | 13.1 |
| | Example | | |
| — | 1 | 50 or more | — |
| — | 2 | 50 or more | — |
| — | 3 | 7.5 | — |
| — | 4 | 8.7 | — |
| — | 5 | 50 or more | — |
| — | 6 | 50 or more | — |
| — | 7 | 50 or more | — |
| — | 8 | — | 50 or more |
| — | 9 | — | 50 or more |

Reference Example 6

A pigment paste was prepared by grinding 100 g of copper phthalocyanine, 50 g (solid content) of the pigment grinding agent of Reference Example 1, 350 g of styrene, 350 g of n-butyl methacrylate and 1,700 g of glass beads using a sand grinder for 2 hours and then filtering to remove the glass beads.

Reference Examples 7to 11

Pigment pastes were prepared as generally described in Reference Example 6, using 50 g of the pigment grinding agent, 100 g of the pigment and 700 g of the vinyl monomers as shown in Table 2.

TABLE 2

| Reference Example | Pigment grinding agent | Pigment | Vinyl monomer (g) | |
|---|---|---|---|---|
| 7 | Reference Example 2 | Mogal L*[1] | Styrene | (500) |
| | | | Ethylhexyl methacrylate | (200) |
| 8 | Reference Example 3 | Special Black #100*[2] | Styrene | (400) |
| | | | n-Butyl methacrylate | (300) |
| 9 | Reference Example 3 | Pigment yellow 12 | Styrene | (550) |
| | | | n-Butyl acrylate | (150) |
| 10 | Reference Example 4 | Pigment red 122 | Styrene | (350) |
| | | | n-Butyl methacrylate | (350) |
| 11 | Reference Example 5 | Copper phtharocyanine | Styrene | (350) |
| | | | n-Butyl methacrylate | (350) |

*[1]available from Cabot Co., Ltd.
*[2]available from Tegsa Co., Ltd.

Examples 1 to 7 same reaction vessel as Reference Example 1 was charged with the dispersion polymerization stabilizer and the solvent (1,200 g) of Table 3, and heated to a temperature indicated in Table 3. To the content, the pigment paste (255 g) was added and then a mixture of styrene (90 g), the polymerization initiator and a cross-linking agent was added. Polymerization continued until the conversion rate was more than 98%. The obtained particles were centrifugally separated and rinsed with methanol, and the separation and rinsing repeated three times, followed by vacuum drying. Then, the obtained polymer was ground using a sample mill to obtain toner. The particle size and particle size distribution (variation coefficient) of the obtained toner particles were measured by a coulter counter. The volume resistance of the toner was also determined in an electric field of 1 KV/cm. The results of the measurement are shown in Table 3. A photograph of the toner of Example 4 was taken by a transmission electron microscope to find that the pigment was uniformly dispersed in the toner particle. The photograph is submitted as FIG. 1.

methyl methacrylate, 280 g of n-butyl methacrylate and 1,700 g of glass beads using a sand grinder for 2 hours and then filtering to remove the glass beads.

(Preparation of Toner)

A same reaction vessel as mentioned above was charged with 60 g of the dispersion stabilizer, 2,160 g of Isopar G and 300 g of xylene, and heated to 90° C. A mixture of 440 g of the above pigment paste, 100 g of methyl methacrylate and 6 g of t butylperoxy-2-ethylhexanoate was added thereto and reacted for 8 hours at

TABLE 3

| Exam. No. | Pigment grinding paste | Polymerization initiator (g) | Crosslinking agent (g) | Solvent (g) | Dispersion porimarization stabilizer (g) | Temp. (°C.) | Particle size | Variation coefficient | Volume resistance (Ω cm) |
|---|---|---|---|---|---|---|---|---|---|
| 1 | Reference Example 6 | BPO (13.5) | Divinyl benzene (0.36) | iPA (960) Deionized water (240) | Poly (acrylic acid) (33) | 75 | 5.9 | 21.0 | $1.5 \times 10^{15}$ |
| 2 | Reference Example 7 | LPO (5.5) AIBN (10.5) | — | Methanol (1200) | Hydroxypropyl cellulose (36) | 55 | 9.0 | 19.2 | $3.5 \times 10^{15}$ |
| 3 | Reference Example 8 | BPO (3.0) V-40 (15.0) | — | nPA (945) Deionized water (255) | Poly (vinyl acetate) (36) | 85 | 6.9 | 16.4 | $3.0 \times 10^{15}$ |
| 4 | Reference Example 8 | LPO (6.0) V-40 (13.5) | — | nPA (960) Deionized water (240) | *A (36) | 85 | 6.6 | 18.6 | $3.5 \times 10^{15}$ |
| 5 | Reference Example 9 | AIBN (22) | Ethylene glycol dimethacrylate (0.24) | Ethanol (1140) Deionized water (60) | Polyvinyl pyrrolidone (40) | 70 | 8.2 | 22.5 | $2.0 \times 10^{15}$ |
| 6 | Reference Example 10 | BPO (16.0) | — | iPA (960) Deionized water (240) | Poly (acrylic acid) (36) | 75 | 7.6 | 19.5 | $3.0 \times 10^{15}$ |
| 7 | Reference Example 11 | LPO (6.0) U-40 (15.0) | — | nPA (960) Deionized water (240) | Poly (acrylic acid) (30) | 85 | 8.6 | 19.2 | $2.5 \times 10^{15}$ |

*A: Poly(vinyl acetate) having an SH group at the terminal.

Example 8

(Synthesis of a Polymerization Stabilizer)

A four necked flask equipped with a stirrer, a nitrogen gas introducing tube, a dropping funnel, a thermometer, a decanter and a condenser was charged with a 1,000 g of 12-hydroxystearic acid and 30 g of xylene and heated slowly to 220° C. at which reflux continued until an acid value of the solid content indicated 45. After the completion of the reaction, it was cooled and 640 g of Isopar G (isoparaffin available from Exxon Corporation) and 0.5 g of hydroquinone monomethyl ether were added and kept at 130° C. in a nitrogen atmosphere. To the content, 470 g of glycidyl methacrylate was added and reacted until an acid value of the solid content reached to less than 3.

A same flask as mentioned above was charged with 870 g of Isopar G and kept at 120 with stirring in a nitrogen atmosphere. To the content, a mixture of 430 g of the above obtained macromonomer, 500 g of methyl methacrylate, 2-ethylhexyl methacrylate and 15 g of t-butylperoxy-2-ethyl hexanoate was added dropwise for 3 hours. After the completion of the addition, the reaction continued at the same temperature for 2 hours and terminated to obtain a polymerization stabilizer which was a methacrylate of long hydrocarbon chain and had a solid content of 50%.

(Preparation of a Pigment Paste)

A pigment paste was prepared by grinding 100 g of copper phthalocyanine, 50 g (solid content) of the pigment grinding agent of Reference Example 1, 420 g of 90° C. The resultant solution was subjected to centrifugal separation and rinse with hexane and then dried at 40° C. The obtained dried polymer was ground by a sample mill. The particle size and particle size distribution were measured by a coulter counter to find an average particle size of 5.3 micron, a variation coefficient of 19.6% and a volume resistance of $1.3 \times 10^{15}$ ohm cm.

Example 9

A toner was prepared as generally described in Example 8, with the exception that 35 g of butylated melamine resin (mineral spirit tolerance = 50 or more), 2,100 g of an aliphatic naphtha and 400 g of xylene were employed instead of the polymerization stabilizer. The toner had an average particle size of 6.2 micron, a variation coefficient of 18.4 % and a volume resistance of $2.0 \times 10^{15}$ ohm cm.

Example 10

Preparation of a Pigment Paste Containing a Polypropylene Wax

| Ingredients | Parts by weight (g) |
|---|---|
| Raven 14 | 125 |
| n-Butyl methacrylate | 300 |
| Styrene | 300 |
| Acryl-graft wax | 200 |
| The pigment grinding agent of Reference Example 3 | 110 |

The above ingredients were employed and a pigment paste was prepared as generally described in Reference Example 6.

(2) Preparation of toner

| Ingredients | Parts by weight (g) |
|---|---|
| Isopropanol | 960 |
| Deionized water | 240 |
| Poly(vinyl acetate) | 18 |
| HPC-L (available from Nihon Soda Co., Ltd.) | 18 |

The above ingredients were heated to 70° C., to which 310.5 g of the pigment paste was added and mixed for minutes. To the content, 10 g of V-59 (azo initiator available from Wako Junyaku Co., Ltd.) and 120 g of styrene were added and polymerized for 16 hours to obtain toner particles having a particle size of 6.6 micrometer, a variation coefficient of 22.3% and a volume resistance of $5\times10^{15}$ ohm cm.

Example 11

Toner particles were obtained as generally described in Example 10 with the exception that Mogal L was employed instead of Raven 14. The obtained particles had a particle size of 7.4 micrometer, a variation coefficient of 21.4% and a volume resistance of $5\times10^{15}$ ohm cm.

Reference Example 12

(Radically Polymerizable Group containing Carboxylic Acid/Sulfonic Acid Agent)

A two liter separable flask equipped with a temperature controller, a nitrogen gas introducing tube, a dropping funnel, an anchor type stirrer and a condenser was charged with 200 g of ethyleneglycol monoethyl ether acetate and 400 g of xylene and heated to 120° C. To the content, a mixture of 62 g of 2-hydroxyethyl methacrylate, 414 g of ethylhexyl methacrylate, 414 g of t-butyl methacrylate and 10 g of azobisisobutylonitrile was added dropwise over 3 hours and then reacted for another 2 hours. After cooling. 37 g of sulfophthalic anhydride was charged therein and heated to 130° C. At this temperature, a resin acid value was adjusted to 20 at which 182 g of epsilon-caprolactone and 1.2 g of dibutyltin laurate were added and heated to 140° C. The reaction continued until more than 98% by weight of epsilon-caprolactone had been reacted, and allowed to cool. The resultant mixture was again heated to 120° C., to which 50 g of 2-isocyanylethyl methacrylate was added and reacted until the isocyanate peak of IR spectrum had disappeared to obtain a pigment grinding agent.

Reference Example 13

(Radically Polymerizable Group containing Basic Pigment Grinding Agent)

A same reaction vessel as Reference Example 12 was charged with 600 g of ethyleneglycol monoethyl ether acetate and heated to 110° C. To the content, 105 g of diethylaminoethyl methacrylate, 280 g of ethylhexyl methacrylate, 280 g of styrene, 35 g of hydroxyethyl methacrylate and 56 g of V-601 (azo initiator available from Wako Junyaku Co., Ltd.) were added dropwise over 3 hours. After finishing the addition, the reaction continued at 110° C. for one hour and at 130° C. for another one hour. The resultant mixture was cooled to room temperature, to which 30.8 g of methacrylic chloride and 130.8 g of ethyleneglycol monoethyl ether acetate were added dropwise for one hour and the reaction continued for another 2 hours to obtain a pigment grinding agent having Mw 4,630 and Mn 2,070.

Reference Example 14

(Basic Pigment Grinding Agent having a Graft Chain)

(Synthesis of Polymer I)

A same reaction vessel as Reference Example 12 was charged with 169.5 g of methyl isobutyl ketone and 340.5 g of ethyleneglycol monoethyl ether acetate and heated to 130° C. To the content, a mixture of 750 g of glycidyl methacrylate and 150 g of t-butylperoxy 2 ethyl hexanate was added dropwise for 3 hours and stirred for 30 minutes. Then, a mixture of 15 g of t-butylperoxy-2-ethyl hexanate and 75 g of ethyleneglycol monoethyl ether acetate was added dropwise for 30 minutes and stirred for one hour to obtain a polymer I. The obtained polymer I had a heat residue (105° C. for 3 hours) of 50%, an epoxy equivalent of 284 and an Mw/Mn=1,800/1,000 and was a homopolymer of 7 glycidyl methacrylates.

(Synthesis of Polymer II)

A same reaction vessel as Reference Example 12 was charged with 159.1 g of methyl isobutyl ketone and 572.5 g of ethyleneglycol monoethyl ether acetate and heated to 120 ° C. with stirring. Next, (a) 550 g of n-butyl methacrylate, (b) a mixture of 55.0 g of thioglycolic acid and 55.0 g of ethyleneglycol monoethyl ether acetate, and (c) a mixture of 11.1 g of 4,4'-azobis(4-cyanovaleric acid), 3.0 g of triethylamine and 30.0 g of ethyleneglycol monoethyl ether acetate were separately added dropwise for 3 hours and stirred for another one hour to terminate the reaction. The obtained polymer II has an acid value of terminal carboxylic groups of 29.0.

(Synthesis of a Graft Type Basic Pigment Grinding Agent having a Radically Polymerizable Double Bond)

A same reaction vessel as Reference Example 12 was charged with 340.8 g of the polymer I, 258.5 g of the polymer II and 142 g of an equimolar adduct (Acryl Ester PA available from Mitsubishi Rayon Co., Ltd.) of 2 hydroxyethyl methacrylate and phthalic anhydride, and a reaction of epoxy and carboxyl group was conducted with stirring until an acid value reached to 0.

Next, the reaction mixture was cooled to less than 50° C., to which 47.0 g of diethylamine was added and heated to 100° C. to conduct a reaction between epoxy group and secondary amine for 3 hours. The resultant mixture has an epoxy equivalent of 1,610,000 which showed that more than 99.9% epoxy group was reacted. The resultant mixture was kept 70° C. under a reduced pressure to remove excess amine with methyl isobutyl ketone. The obtained pigment grinding agent had an amine equivalent of 0.50 meq/g and an iodine value of 4.3, which showed that the obtained material was a basic graft polymer.

Reference Example 15

(An Acidic Pigment Grinding Agent having a Chain Transfer Radically Polymerizable Group)

A same reaction vessel as Reference Example 12 was charged with 600 g of 1,4-dioxane and heated to 100° C. A mixture of 100 g of methacrylic acid, 320 g of styrene, 120 g of n-butyl methacrylate, 160 g of n-hexyl methacrylate, 46 g of azobisisobutylonitrile and 10.4 g of thioglycolic acid was added dropwise for 2 hours. After the completion of the addition, the reaction continued for one hour to which 10.5 g of azobisisobutylonitrile and 100 g of xylene were added dropwise for one hour and polymerized for another 2 hours. Then, 500 ml of an thanol solution of 0.1N sodium hydroxide was added thereto and stirred for about 30 minutes. After cooling, deionized water was added two times to separate to obtain a pigment grinding agent. The obtained agent had a SH concentration of $1.6\times10^{-4}$ mol/g, an Mw of 3,550 and an Mn of 1,520.

Reference Example 16

(An Acidic Pigment Grinding Agent having a Graft Chain)

(Synthesis of Polymer I)

A same reaction vessel as Reference Example 12 was charged with 476.0 g of ethyleneglycol monoethyl ether acetate and heated to 130° C. with stirring. To the content, a mixture of 315.3 g of glycidyl methacrylate, 384.7 g of 2hydroxyethyl methacrylate and 70 g of t-butylperoxy-2-ethyl hexanate was added dropwise for 3 hours and stirred for 30 minutes. Then, a mixture of 7 g of t-butylperoxy-2 ethyl hexanate and 70 g of ethyleneglycol monoethyl ether acetate was added dropwise for 30 minutes and stirred for one hour to obtain a polymer I. The obtained polymer I had a heat residue (105° C. for 3 hours) of 55% and an epoxy equivalent of 596 and an Mw/Mn=3,400/1,800.

(Synthesis of a Graft Type Acidic Pigment Grinding Agent having a Radically Polymerizable Double Bond)

A same reaction vessel as Reference Example 12 was charged with 472.5 g of the polymer I obtained above, 2395.2 g of the polymer II of Reference Example 14, 77.2 g of an equimolar adduct (Acryl Ester PA available from Mitsubishi Rayon Co., Ltd.) of 2-hydroxyethyl methacrylate and phthalic anhydride and 8.8 g of triethylamine, and a reaction of epoxy and carboxyl group was conducted with stirring until an epoxy equivalent reached to 250,000.

Next, 152.2 g of trimellitic anhydride was added thereto and heated to 120° C. to conduct a reaction between hydroxyl group and acid anhydride for 2 hours. The obtained pigment grinding agent had an acid value of 48 mg KOH/g and an iodine value of 2.1, which showed that the obtained material was an acidic graft polymer.

Water (hexane) tolerances of the pigment grinding agents of Reference Examples 12 to 16 and the dispersion polymerization stabilizers of Examples 12 to 20 are shown in Table 4.

TABLE 4

| Pigment grinding agent | Dispersion polymerization stabilizer | Water tolerane | Hexane tolerane |
|---|---|---|---|
| Reference Example | | | |
| 12 | — | 3.2 | 7.7 |
| 13 | — | 2.5 | 10.3 |
| 14 | — | 2.2 | 10.5 |
| 15 | — | 1.6 | 15.2 |
| 16 | — | 2.2 | 12.4 |
| | Example | | |
| — | 12 | 50 or more | — |
| — | 13 | 50 or more | — |
| — | 14 | 7.5 | — |
| — | 15 | 8.7 | — |
| — | 16 | 50 or more | — |
| — | 17 | 50 or more | — |
| — | 18 | 50 or more | — |
| — | 19 | — | 50 or more |
| — | 20 | — | 50 or more |

Reference Example 17

A pigment paste was prepared by grinding 100 g of copper phthalocyanine, 50 g (solide content) of the pigment gtrinding agtent of Reference Example 12, 350 g of styrene, 350 g of n-butyl methacrylate and 1,700 g of glass beads using a sand grinder for 2 hours and then filtering to remove the glass beads.

Reference Examples 18 to 22

Pigment pastes were prepared as generally described in Reference Example 6, using 50 g of the pigment grinding agent, 100 g of the pigment and 700 g of the vinyl monomers as shown in Table 5.

TABLE 5

| Reference Example | Pigment grinding | Pigment | Vinyl monomer (g) | |
|---|---|---|---|---|
| 18 | Reference Example 13 | Mogal L*1 | Styrene | (500) |
| | | | Ethylhexyl methacrylate | (200) |
| 19 | Reference Example 14 | Special Black #100*2 | Styrene | (400) |
| | | | n-Butyl methacrylate | (300) |
| 20 | Reference Example 15 | Pigment yellow 12 | Styrene | (550) |
| | | | n-Butyl acrylate | (150) |
| 21 | Reference Example 16 | Pigment red 122 | Styrene | (350) |
| | | | n-Butyl methacrylate | (350) |
| 22 | Reference Example 17 | Copper phtharocyanine | Styrene | (350) |
| | | | n-Butyl methacrylate | (350) |

*1available from Cabot Co., Ltd.
*2available from Tegsa Co., Ltd.

Examples 12 to 18

A same reaction vessel as Reference Example 12 was charged with the dispersion polymerization stabilizer and the solvent (1,200 g) of Table 6, and heated to a temperature indicated in Table 6. To the content, the pigment paste (255 g) was added and then a mixture of styrene (90 g), the polymerization initiator and a crosslinking agent was added. Polymerization continued until the conversion rate was more than 98%. The obtained particles were centrifugally separated and rinsed with methanol, and the separation and rinsing repeated three times, followed by vacuum drying. Then, the obtained polymer was ground using a sample mill to obtain toner. The particle size and particle size distribution (variation coefficient) of the obtained toner particles were measured by a coulter counter. The volume resistance of the toner was also determined in an electric field of 1 KV/cm. The results of the measurement are shown in Table 6.

TABLE 6

| Exam. No. | Pigment grinding paste | Polymerization initiator (g) | Crosslinking agent (g) | Solvent (g) | Dispersion porimarization stabilizer (g) | Temp. (°C.) | Particle size | Variation coefficient | Volume resistance (Ω cm) |
|---|---|---|---|---|---|---|---|---|---|
| 12 | Reference Example 17 | BPO (13.5) | Divinyl benzene (0.36) | iPA (960) Deionized water (240) | Poly (acrylic acid) (33) | 75 | 5.7 | 19.7 | $1.5 \times 10^{15}$ |
| 13 | Reference Example 18 | LPO (5.5) AIBN (10.5) | — | Methanol (1200) | Hydroxy-propyl cellulose (36) | 55 | 9.2 | 18.3 | $3.5 \times 10^{15}$ |
| 14 | Reference Example 19 | BPO (3.0) V-40 (15.0) | — | nPA (945) Deionized water (255) | Poly (vinyl acetate) (36) | 85 | 6.8 | 16.2 | $3.0 \times 10^{15}$ |
| 15 | Reference Example 19 | LPO (6.0) V-40 (13.5) | — | nPA (960) Deionized water (240) | *A (36) | 85 | 6.2 | 15.5 | $3.5 \times 10^{15}$ |
| 16 | Reference Example 20 | AIBN (22) | Ethylene glycol di-meth-acrylate (0.24) | Ethanol (1140) Deionized water (60) | Poly-vinyl pyrrol-idone (40) | 70 | 8.5 | 20.5 | $2.0 \times 10^{15}$ |
| 17 | Reference Example 21 | BPO (16.0) | — | iPA (960) Deionized water (240) | Poly (acrylic acid) (36) | 75 | 7.4 | 18.0 | $3.0 \times 10^{15}$ |
| 18 | Reference Example 22 | LPO (6.0) U-40 (15.0) | — | iPA (960) Deionized water (240) | Poly (acrylic acid) (30) | 85 | 8.2 | 17.5 | $2.5 \times 10^{15}$ |

A*: Poly(vinyl acetate) having an SH group at the terminal.

Example 19

(Synthesis of a Polymerization Stabilizer)

A four necked flask equipped with a stirrer, a nitrogen gas introducing tube, a dropping funnel, a thermometer, a decanter and a condenser was charged with a 1,000 g of 12-hydroxystearic acid and 30 g of xylene and heated slowly to 220° C. at which reflux continued until an acid value of the solid content indicated 45. After the completion of the reaction, it was cooled and 640 g of Isopar G (isoparaffin available from Exxon Corporation) and 0.5 g of hydroquinone monomethyl ether were added and kept at 130° C. in a nitrogen atmosphere. To the content, 470 g of glycidyl methacrylate was added and reacted until an acid value of the solid content reached to less than 3.

A same flask as mentioned above was charged with 870 g of Isopar G and kept at 120 with stirring in a nitrogen atmosphere. To the content, a mixture of 430 g of the above obtained macromonomer, 500 g of methyl methacrylate, 2-ethylhexyl methacrylate and 15 g of t-butylperoxy-2-ethyl hexanoate was added dropwise for 3 hours. After the completion of the addition, the reaction continued at the same temperature for 2 hours and terminated to obtain a polymerization stabilizer which was a methacrylate of long hydrocarbon chain and had a solid content of 50%.

(Preparation of a Pigment Paste)

A pigment paste was prepared by grinding 100 g of copper phthalocyanine, 50 g (solid content) of the pigment grinding agent of Reference Example 12, 420 g of methyl methacrylate, 280 g of n-butyl methacrylate and 1,700 g of glass beads using a sand grinder for 2 hours and then filtering to remove the glass beads.

(Preparation of Toner)

A same reaction vessel as mentioned above was charged with 60 g of the dispersion stabilizer, 2,160 g of Isopar G and 300 g of xylene, and heated to 90° C. A mixture of 440 g of the above pigment paste, 100 g of methyl methacrylate and 6 g of t butylperoxy-2-ethylhexanoate was added thereto and reacted for 8 hours at 90° C. The resultant solution was subjected to centrifugal separation and rinse with hexane and then dried at 40° C. The obtained 15. dried polymer was ground by a sample mill. The particle size and particle size distribution were measured by a coulter counter to find an average particle size of 4.7 micron, a variation coefficient of 19.2% and a volume resistance of $1.3 \times 10^{15}$ ohm cm.

Example 20

A toner was prepared as generally described in Example 19, with the exception that 35 g of butylated melamine resin, 2,100 g of an aliphatic naphtha and 400 g of xylene were employed instead of the polymerization stabilizer. The toner had an average particle size of 5.3 micron, a variation coefficient of 21.4% and a volume resistance of $2.0 \times 10^{15}$ ohm cm.

Example 21

(1) Preparation of a pigment paste containing a polypropylene wax

| Ingredients | Parts by weight (g) |
|---|---|
| Raven 14 | 125 |
| n-Butyl methacrylate | 300 |
| Styrene | 300 |
| Acryl-graft wax | 200 |
| The pigment grinding agent of Reference Example 14 | 110 |

The above ingredients were employed and a pigment paste was prepared as generally described in Reference Example 17.

(2) Preparation of toner

| Ingredients | Parts by weight (g) |
|---|---|
| Isopropanol | 960 |
| Deionized water | 240 |
| Poly(vinyl acetate) | 18 |

-continued

| Ingredients | Parts by weight (g) |
|---|---|
| HPC-L (available from Nihon Soda Co., Ltd.) | 18 |

The above ingredients were heated to 70° C., to which 310.5 g of the pigment paste was added and mixed for 30 minutes. To the content, 10 g of V-59 (azo initiator available from Wako Junyaku Co., Ltd.) and 120 g of styrene were added and polymerized for 16 hours to obtain toner particles having a particle size of 6.8 micrometer, a variation coefficient of 21.0% and a volume resistance of $5\times10^{15}$ ohm cm.

Example 22

Toner particles were obtained as generally described in Example 21 with the exception that Mogal L was employed instead of Laben 14. The obtained particles had a particle size of 7.3 micrometer, a variation coefficient of 19.5% and a volume resistance of $5\times10^{15}$ onm cm.

Comparative Example 1

Figure 2:
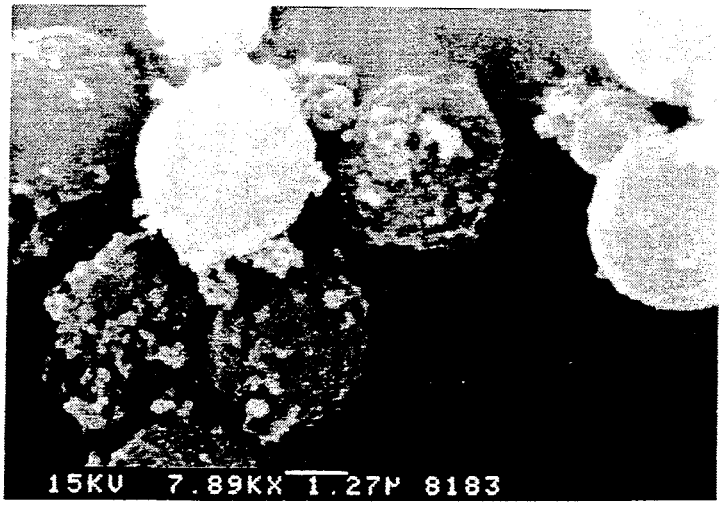
FIG. 2 is a photograph of the toner of Comparative Example 1 taken by an electron microscope.

Toner particles were prepared as generally described in Example 4 with the exception that the pigment grinding agent was not employed. A photograph of the obtained toner particle was taken by a transmittance electron microscope to find that the pigment was flocculated outside the particle and therefore it was difficult to use as toner. The photograph is submitted as FIG. 2.

What is claimed is:

1. A process for producing toner, comprising dispersion-polymerizing (I) a pigment paste comprising (A) a pigment grinding agent having basic groups, acidic groups or both, (B) a pigment and (C) vinyl monomers, (II) a polymerization initiator and (III) a dispersion polymerization stabilizer in a dispersion medium which dissolves said vinyl monomers (C) and a dispersion polymerization stabilizer (III) and which does not dissolve polymerized resin particles.

2. The process according to claim 1 wherein said pigment grinding agent has radically reactive groups.

3. The process according to claim 1 or claim 2 wherein said pigment paste further contains (D) a lubricant.

4. The process according to claim 3 wherein said lubricant (D) is selected from the group consisting of polyethylene wax, polypropylene wax, polydimethylsiloxane and a modified wax thereof.

5. The process according to anyone of claims 1 to wherein said pigment grinding agent (A) has a water tolerance of 5.0 or less and said dispersion polymerization stabilizer (III) has a water tolerance of 7.0 or more.

6. The process according to anyone of claims 1 to wherein said pigment grinding agent (A) has a hexane tolerance of 20 or less and said dispersion polymerization stabilizer (III) has a hexane tolerance of 30 or more.

* * * * *